US007044344B2

(12) United States Patent
Winkler

(10) Patent No.: US 7,044,344 B2
(45) Date of Patent: May 16, 2006

(54) CONTAINER FOR A GOLF CAR WITH REMOVABLY ATTACHABLE GOLFING ACCESSORY

(75) Inventor: David R. Winkler, Pacific, MO (US)

(73) Assignee: Covered Solutions, Inc., Pacific, MO (US)

( * ) Notice: Subject to any disclaimer, the term of this patent is extended or adjusted under 35 U.S.C. 154(b) by 53 days.

(21) Appl. No.: 10/316,321

(22) Filed: Dec. 11, 2002

(65) Prior Publication Data

US 2004/0112774 A1 Jun. 17, 2004

(51) Int. Cl.
*B60R 9/00* (2006.01)

(52) U.S. Cl. ..... 224/274; 224/511; 224/546; 224/547

(58) Field of Classification Search ..... 224/274, 224/511, 546, 547; 220/23.4, 23.83; 206/315.2, 206/315.3, 315, 315.03
See application file for complete search history.

(56) References Cited

U.S. PATENT DOCUMENTS 3,010,628 A * 11/1961 Kowalczyk ..... 224/274
3,225,951 A * 12/1965 Poston et al. ..... 215/6
4,989,767 A * 2/1991 Buschbom ..... 224/274
5,035,389 A * 7/1991 Wang ..... 248/224.51
5,105,958 A * 4/1992 Patton ..... 215/388
D387,117 S * 12/1997 Danyluk ..... D21/795
5,727,642 A * 3/1998 Abbott ..... 180/65.1
5,816,396 A * 10/1998 Shin ..... 206/315.3
6,126,050 A * 10/2000 Aliano, Jr. ..... 224/274
6,227,427 B1 * 5/2001 Kunz ..... 224/547
6,394,325 B1 * 5/2002 Taylor ..... 224/274
D463,225 S 9/2002 Winkler
D463,226 S 9/2002 Winkler
2002/0033402 A1 3/2002 Winkler
2002/0056728 A1 5/2002 Winkler

* cited by examiner

*Primary Examiner*—Stephen K. Cronin
(74) *Attorney, Agent, or Firm*—Polster, Lieder, Woodruff & Lucchesi, L.C.

(57) ABSTRACT

A container for a golf car has a connector for connecting a golfing accessory to the container. The connector comprises a pair of notches formed in the container for receiving a pair of clips formed in the golf accessory. The golfing accessory is solely supported from the container by the connector and permits non-interfering use of the container and the golfing accessory when the golfing accessory is attached to the container.

23 Claims, 7 Drawing Sheets

CONTAINER FOR A GOLF CAR WITH REMOVABLY ATTACHABLE GOLFING ACCESSORY

BACKGROUND OF THE INVENTION (1) Field of the Invention

The present invention pertains to a golfing accessory that may be mounted to a golf car to provide convenience to the golfer and added functionality to the golf car. Specifically, the invention pertains to an improved design for a golfing accessory in the form of a container for a golf car which mounts to the golf car in a convenient location that does not detract from the overall visual appearance of the golf car. The container, which may be used as a divot mix container or a beverage cooler among other uses, is adapted to allow one or more other type of golfing accessories, such as ball washers, club washers, etc., to be mounted to the container to further increase the functionality of the golf car and convenience for the golfer.

(2) Description of the Related Art

Golf cars have been equipped with various devices to hold and store a golfer's personal belongings and other items that a golfer may desire during the course of playing a round of golf. For example, these devices may include golf tee holders, golf ball holders, score card clips and various other baskets and containers to hold and store beverages, sweaters, and drinks. One such device that has been found to be a convenient item to place in a golf car is a divot mix container which is used to refill a divot hole with divot mix after a golfer takes a divot with his or her shot. One specific type of divot mix container has been disclosed in the inventor's previous patents and patent applications, including: U.S. Pat. Nos. D463,225 and D463,226; and Patent Applications US-2002/0041106-A1; US-2002/0027373-A1; and US-2002/033402-A1, the disclosures of which are hereby incorporated by reference.

Devices of the type shown in these references have proven very useful because they are portable and releasably mounted to the golf car in convenient places so that they are readily accessible making them more apt to being used by the golfer. The devices of the type shown in these references serve three important functions: providing convenience to the golfer, added functionality to the golf car and providing a golf course with a means to assist in the maintenance of the golf course.

BRIEF SUMMARY OF THE INVENTION

The inventor has continued his work and developed still another apparatus which accomplishes these three goals. The apparatus of the present invention is a container which has its own unique utility and which serves as a platform to allow other commonly used golfing accessories, such as ball washers and club washers, to be releasably attached to it in a customizable configuration. In this way, a combination or assembly of commonly used golfing accessories may be readily mounted to the golf car without detracting from the overall appearance of the golf car thereby providing added functionality to the golf car and convenience to a golfer. Additionally, for a golf course owning a fleet of golf cars, the golf course is able to customize its fleet of golf cars with the accessories it desires or finds most suitable for its course.

Among the aspects of the present invention is the provision of a container that attaches to the golf car. The container may serve as a stand-alone item or may be configured as desired to include any number of desired golfing accessories, such as a ball washer or club washer. As a stand alone item, the container may function as a container for holding divot mix or a cooler for storing beverages. The large flat surfaces of the container are ideal locations for positioning the other golfing accessory items. Thus, the invention provides a container that is adapted to allow a golfing accessory to be releasably attached to the container in a manner such that the golfing accessory is solely supported by the container and does not interfere with use of the container or the golfing accessory when the golfing accessory is attached. Preferably, the container is provided with a portion of a connector integrally formed with the container that interlocks with a complementing portion of a connector of the golfing accessory thereby allowing the golfing accessory to be mounted to the container as desired.

By providing multiple connector portions in different locations on the container, one or more golfing accessories may be selectively positioned on the container depending upon a desired method of customization of the golf car. Thus, the invention provides a flexible way of configuring needed golfing accessories of the golf car, which can be advantageous, for example, when deciding whether to position the container on the driver or passenger side of the golf car or in the center of the golf car. Additionally, depending upon the location of the container on the golf car relative to the rear golf bag storage compartment and relative to protective coverings installed on the golf car, the golfing accessory may be selectively positioned on the container to ensure minimal interference from these items. By providing a releasable attachment, the golfing accessory may be released or detached from the container and reattached in a new position, as necessary, if the container is moved or relocated on the golf car. Accordingly, the present invention allows for an infinite number of combinations and the ability for a golf car owner or golfer to customize his or her golf car in the manner desired, where the container by itself provides a platform or building block for these customized combinations.

Another aspect of the invention is the provision of a golfing accessory assembly having a container that attaches to the golf car and a golfing accessory that is adapted to be releasably attached to the container in a manner where the golfing accessory is solely supported by the container in a position that does not interfere with use of the container and the golfing accessory. Preferably, the container and the golfing accessory are attached together without the use of separate fasteners. More preferably, the container and the golfing accessory have a system of cooperating clips and notches that allow the container and the golfing accessory to be releasably attached or snapped together or separated as desired. In this way, the container and the golfing accessory can be joined together as an integral unit which is sufficiently rigid to allow the golfing accessory assembly to withstand the rigors of repeated use and abuse that is common for golfing accessories on a golf course, especially ones that are attached to a golf car which itself is driven over the bumpy terrain of the golf course.

Another aspect of the invention is a method comprising attaching a container to a golf car and releasably attaching a first golfing accessory to the container without the use of separate fasteners in a manner such that the first golfing accessory is solely supported by the container and does not interfere with use of the container or the first golfing accessory. To provide optimum utilization of the container, under this method, a second golfing accessory may be attached to the container in a manner such that the second golfing accessory is solely supported by the container and does not interfere with use of the container, or use of the first or second golfing accessories. In order to provide maximum utilization and customization opportunities, the first or second golfing accessories may be removed from the container and each may be selectively positioned on the container as desired or either one may be removed completely depending upon the desired configuration.

As will be seen from the description that follows, the present invention enhances the utility of a golf car and provides the golf car owner or golfer with several customization options which provide convenience and an increased enjoyment level when playing golf.

BRIEF DESCRIPTION OF THE DRAWINGS

Further objects and features of the invention are revealed in the following detailed description of the preferred embodiment of the invention and in the drawings wherein.

Corresponding reference characters indicate corresponding parts throughout the several views of the drawings.

DETAILED DESCRIPTION OF THE PREFERRED EMBODIMENT

Figure 1:
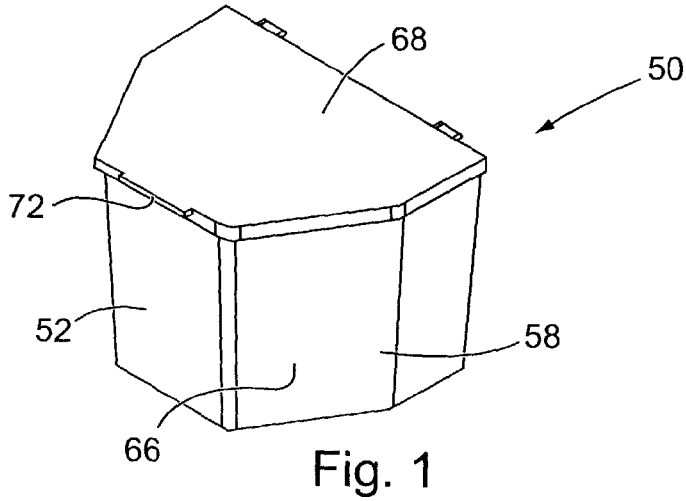
FIG. 1 is a perspective view of a container of the present invention.
Figure 5:
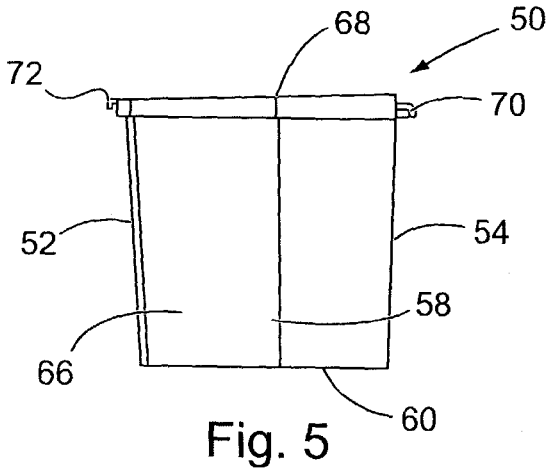
FIG. 5 is a right-side view of the container of FIG. 1.
Figure 6:
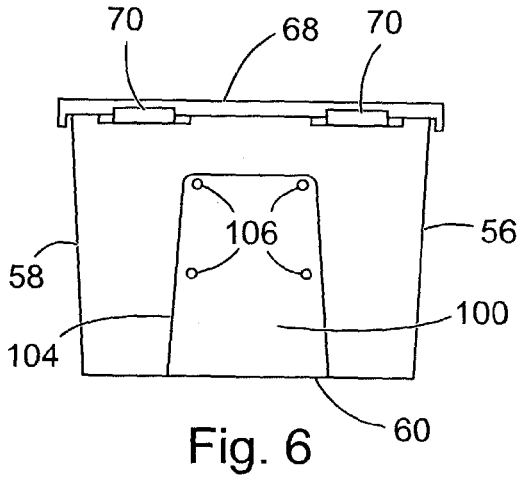
FIG. 6 is a rear view of the container of FIG. 1.

In the description that follows, the terms "left", "right", "front", "back", "top" and "bottom" are used for the sake of convenience in referring to elements of the apparatus of the invention as those elements appear in the drawing figures. These terms are used to facilitate an understanding of the invention and the terms should not be viewed or construed as limiting the invention or the arrangement of the elements to the specific configuration and orientation recited.

FIGS. 1–8 show a general arrangement of a container 50 of the present invention. The container 50 has opposite front and back walls 52,54 spaced apart by left and right side walls 56,58 and a bottom wall 60 defining an interior volume of the container. A drain plug 62 is provided in the bottom wall 60 to allow the container to be emptied and to facilitate cleaning or rinsing. Preferably, the left and right side walls 56,58 have portions 64,66 which are obliquely angled to the front wall 56 to provide the container with a general trapezoidal shape as viewed in FIGS. 2 and 7. The obliquely angled portions 64,66 provide a preferred location for mounting additional golfing accessories, as mounting the accessories adjacent the obliquely angled portions reduces the effective width of the assembly, as will be seen from the drawings and the description that follows. Preferably, the left and right side walls 56,58 and the front wall 52 are tapered so that a tight compressive fit may be achieved when the golfing accessories are mounted or abutted to the walls, as will be described in greater detail below.

In accordance with the provisions of the invention, the container 50 preferably functions as a container to hold a divot mix material, which may include any of the following, sand, grass seed, dirt, fertilizer. However, if desired, the first container may also function as a beverage cooler or have another purpose. Accordingly, the container is sized with these uses in mind, i.e. to hold six twelve ounce bottles or cans with room for ice, or a shovel to dispense divot mix, etc. To allow use of the container in many applications, the container is preferably made from a rigid plastic material which may have either solid or hollow walls for greater insulating effect. The material chosen for the first container is preferably of superior strength and resiliency, and weather resistant so that it will not fade in the sun and protect the contents of the container. The inventor has found that a carbon filled plastic commonly referred to as ABS plastic is well suited for the variety of possible uses to which the first container may be put and allows the first container to be produced in a relatively inexpensive molding process with relatively low material costs. ABS carbon-filled plastic is also preferred because it provides protection against environmental elements.

The container 50 preferably has a lid 68 to protect the contents of the container and hinges 70 are provided at the back wall 54 with a handle 72 for the lid positioned adjacent the front wall 52. Preferably, the lid 68 is sloped toward the front wall 52 so that rain water may be directed away from the container and the interior of the golf car. The lid may also be transparent or translucent to allow viewing of the contents of the container. Preferably, the hinges 70 enable the lid to be readily detached from the container 50 by pivoting the lid to an extreme open position which will enable the lid to be detached from the container.

Figure 28:
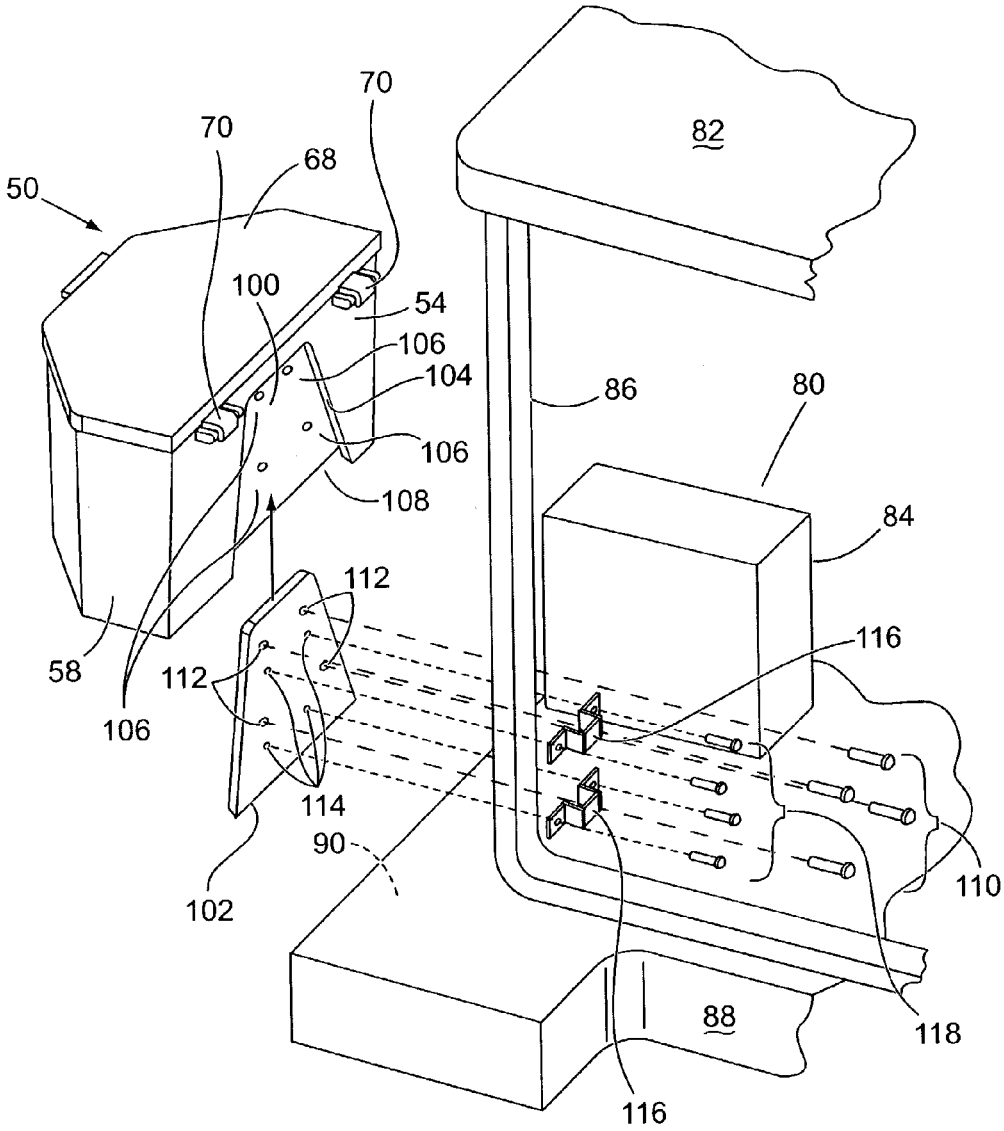
FIG. 28 is an exploded partial perspective view of the container of FIG. 1 showing its attachment to a golf car.

Preferably, the container 50 is attached to a golf car 80 at the back wall 54 such that the front wall 52 and side walls 56,58 are positioned in an area of the golf car which allows the golfer convenient access to the container. Generally, the golf car 80 has a canopy 82 above the passenger compartment 84 which is supported by vertical posts 86 that extend from the chassis of the golf car to the canopy. The vertical support posts 86 usually extend from a midsection of the golf car to a rear portion of the canopy 82. As shown in FIG. 28, the container 50 is preferably attached to a rear vertical support post 86 such that first container is positioned to a side of the golf car between the passenger compartment 84 and a rear golf bag storage area 88 above a rear wheel well 90 of the golf car. Preferably, the container 50 is suspended above the rear wheel well 90 as it is supported by the vertical support post 86.

Figure 8:
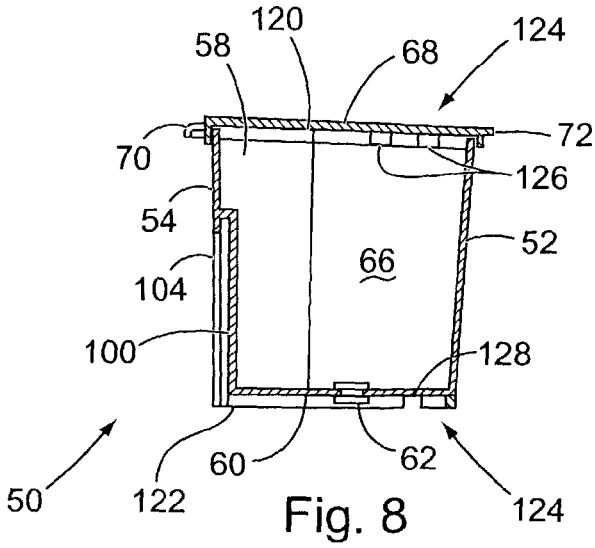
FIG. 8 is a cross-sectional side view taken along lines 8—8 of FIG. 2.
Figure 2:
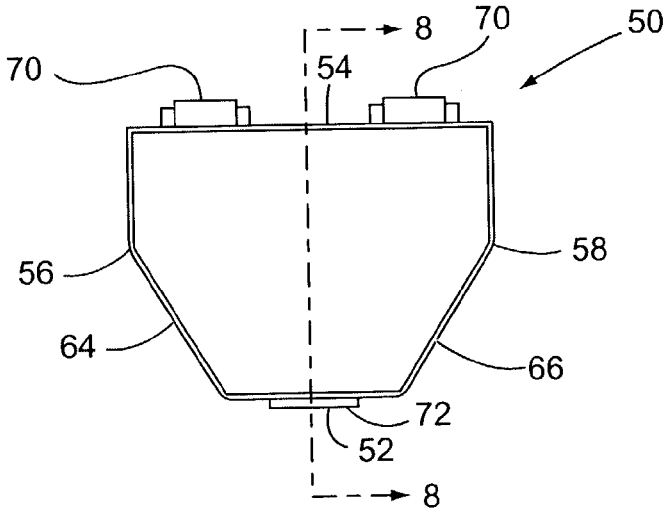
FIG. 2 is a top view of the container of FIG. 1.
Figure 4:
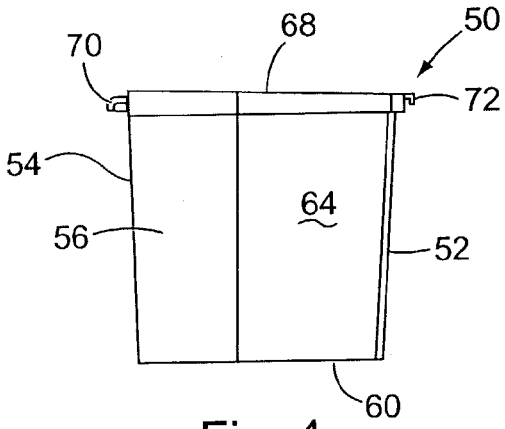
FIG. 4 is a left-side view of the container of FIG. 1.
Figure 3:
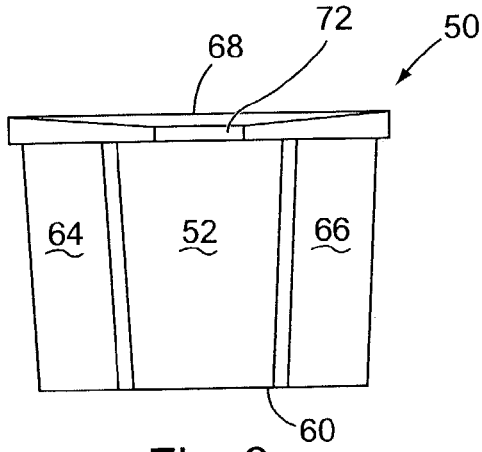
FIG. 3 is a front view of the container of FIG. 1.

Preferably, the back wall 54 is used as a location for attaching the container 50 to the golf car because doing so positions the front of the container in a location where there is typically no interference with the structure of the golf car. When the container 50 is configured to hold a divot mix material, the weight of the filled container may approach 40 to 45 pounds, depending upon the size of the container and the constituency of the divot mix. In order to provide a rigid connection between the container 50 and the golf car support post 86, the back is formed with a recess 100 which receives a reinforcement plate 102 (FIG. 28). Referring to FIG. 8, a lip 104 is formed around the edges of the recess 100 and mounting holes 106, which may be tapped holes, are provided in the recess through the back wall. Preferably, the recess 100 has a generally triangular shape with tapered side walls and the lip 104 extends around the periphery of the recess. The reinforcement plate 102, which is preferably metal, is fitted into the recess from the bottom of the container through a slot 108 in the bottom wall 60 formed from the recess 100 and the lip 104. The reinforcement plate 102 may then be attached to the container with mechanical fasteners 110 directed through fastener holes 112 into the mounting holes 106. The lip 104 provided around the periphery of the recess 100 captures the metal reinforcement plate 102 and holds it in place so that the reinforcement plate does not heel in a forward direction out from recess 100 and away from the container. The recess tapered side walls provide an interlocking fit against the plate 102 which enables the first container to remain tightly seated against the plate under the weight of the container due to the cooperating relationship of the engaging tapers of the recess and reinforcement plate. The reinforcement plate 102 has a set of holes 114 that match a bracket 116 which may be wrapped around the vertical support post 86 of the golf car 80, and with mechanical fasteners 118, the plate 102 and thus, the container 50 may be attached to the golf car (FIG. 28).

Figure 7:
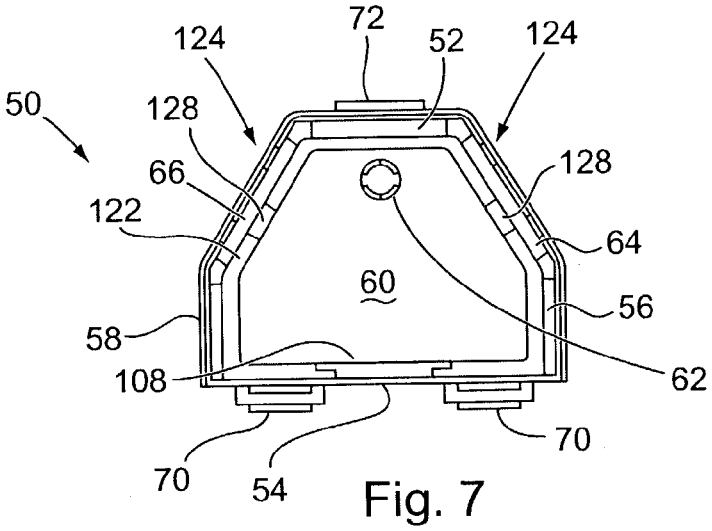
FIG. 7 is a bottom view of the container of FIG. 1.
Figure 11:
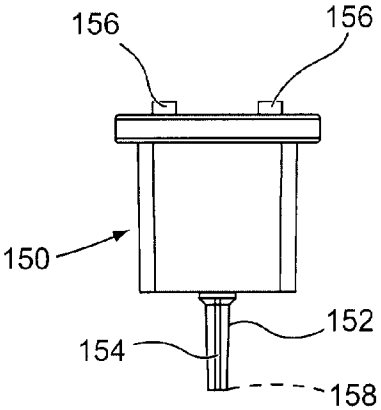
FIG. 11 is a front view of the golfing accessory of FIG. 9.
Figure 14:
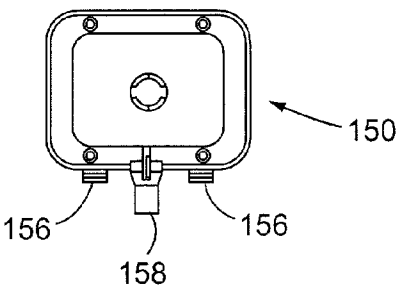
FIG. 14 is a bottom view of the golfing accessory of FIG. 9.
Figure 10:
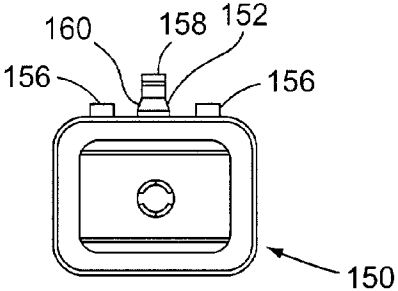
FIG. 10 is a top view of the golfing accessory of FIG. 9.
Figure 13:
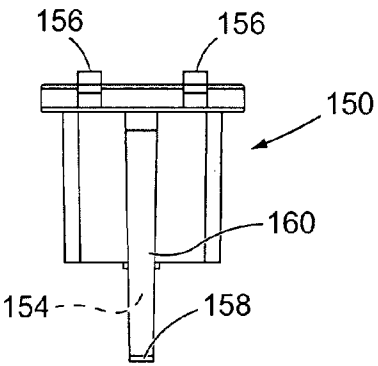
FIG. 13 is a rear view of the golfing accessory of FIG. 9.
Figure 9:
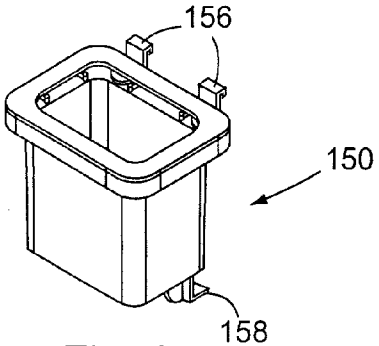
FIG. 9 is a perspective view of an embodiment of a golfing accessory of the present invention which may be releasably attached to the container of FIG. 1.
Figure 12:
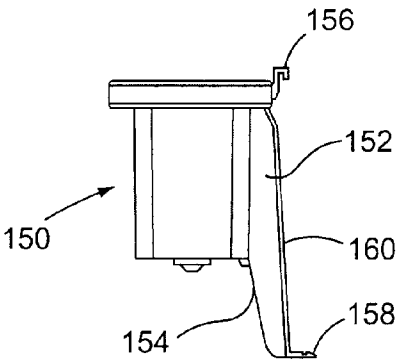
FIG. 12 is a right-side view of the golfing accessory of FIG. 9.
Figure 17:
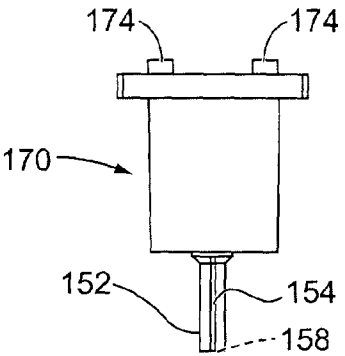
FIG. 17 is a front view of the golfing accessory of FIG. 15.
Figure 20:
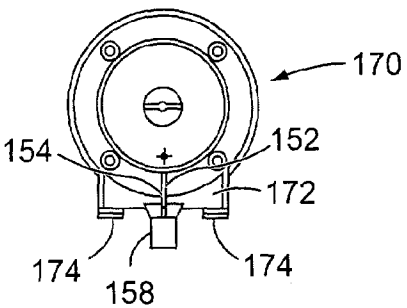
FIG. 20 is a bottom view of the golfing accessory of FIG. 15.
Figure 16:
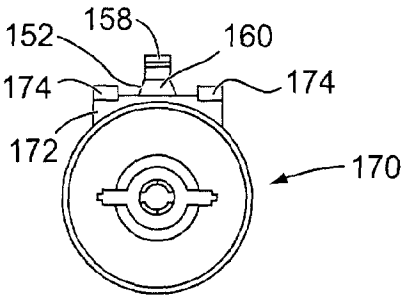
FIG. 16 is a top view of the golfing accessory of FIG. 15.
Figure 19:
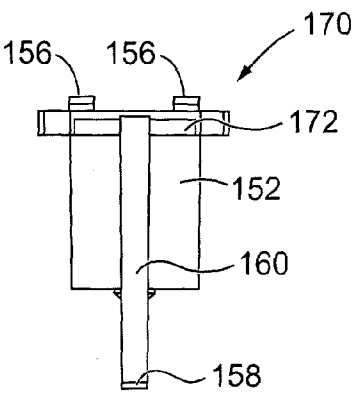
FIG. 19 is a rear view of the golfing accessory of FIG. 15.
Figure 15:
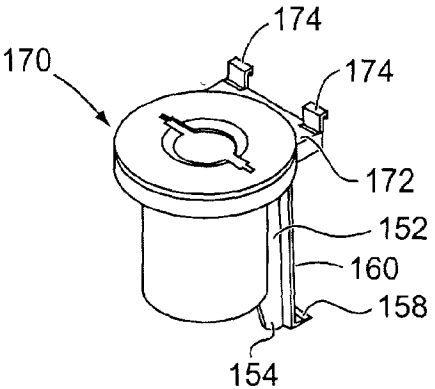
FIG. 15 is a perspective view of an alternate embodiment of the golfing accessory of FIG. 9 which may also be releasably attached to the container of FIG. 1.
Figure 18:
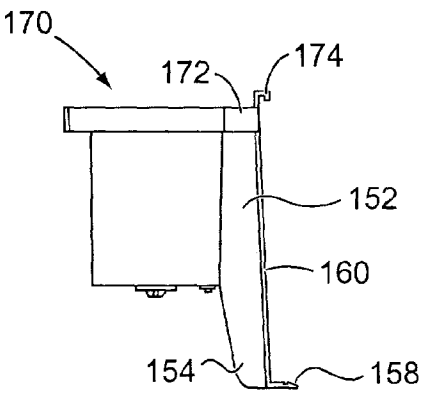
FIG. 18 is a right-side view of the golfing accessory of FIG. 15.
Figure 22:
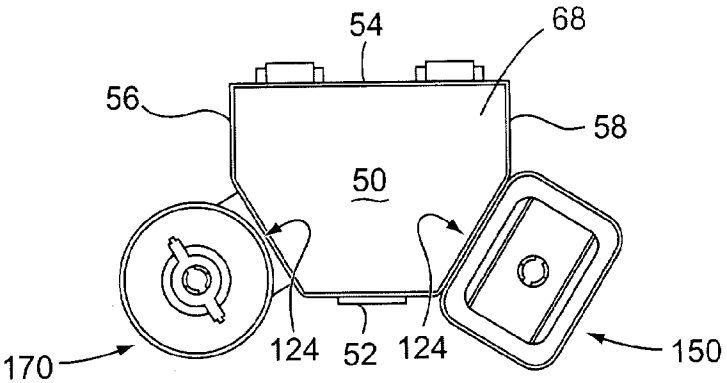
FIG. 22 is a top view of the golfing accessory assembly of FIG. 21.
Figure 24:
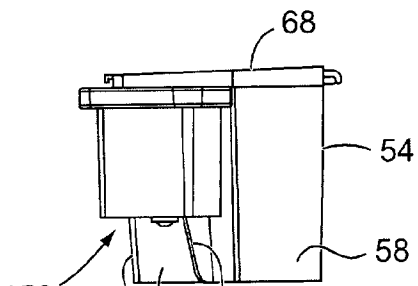
FIG. 24 is a right-side view of the golfing accessory assembly of FIG. 21.
Figure 21:
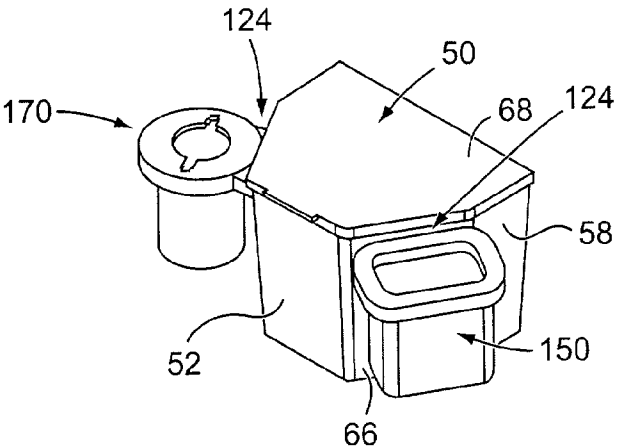
FIG. 21 shows one customization option or one embodiment of a golfing accessory assembly of the present invention where the embodiment of the golfing accessory of FIGS. 9–14 and the embodiment of the golfing accessory of FIGS. 15–20 is shown attached to the container of FIG. 1.
Figure 23:
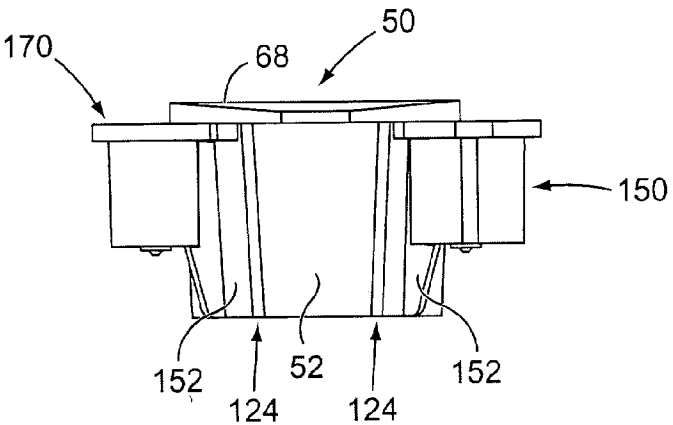
FIG. 23 is a front view of the golfing accessory assembly of FIG. 21.
Figure 26:
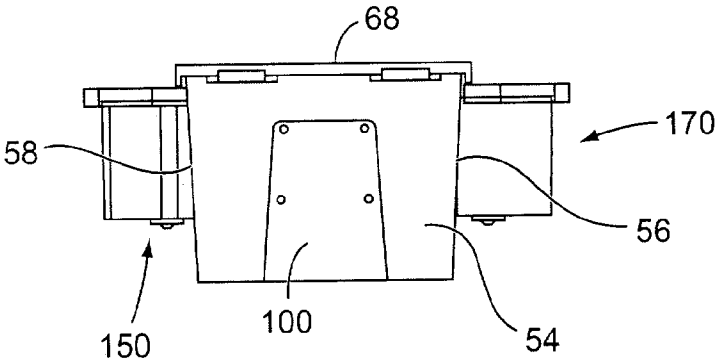
FIG. 26 is a rear view of the golfing accessory assembly of FIG. 21.
Figure 25:
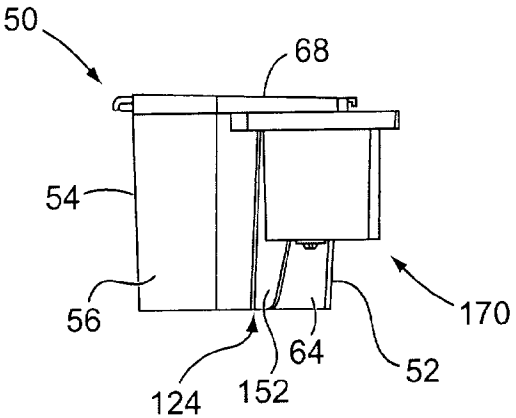
FIG. 25 is a left-side view of the golfing accessory assembly of FIG. 21.
Figure 27:
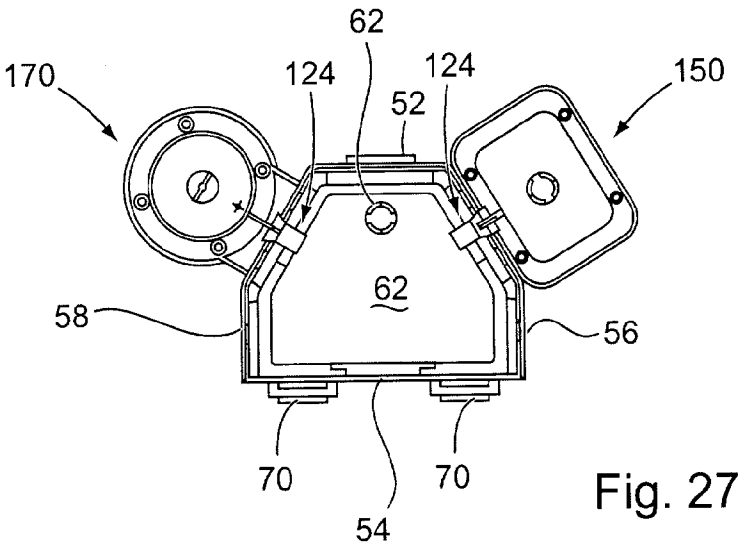
FIG. 27 is a bottom view of the golfing accessory assembly of FIG. 21.

A top rim 120 is provided around the top of the container 50 and preferably extends around the side walls 54, 56, the side wall obliquely angled portions 64, 66, and the front wall 52. The rim 120 is preferably formed to interlock with the lid 68 such that with the lid placed in the closed position, the lid 68 may be engaged with the container to prevent the lid from banging against the container as the golf car is operated, and with modest upward force, the lid may be disengaged from the container to provide access into the container, as desired. Other methods of holding the lid 68 stationary against the container 50 may also be used to ensure the lid remains in the closed position when the golf car is operated over the bumpy terrain commonly found on the golf course. As shown in FIG. 7, the bottom wall 60 of the container is provided with a bottom rim 122 which preferably extends around the entire bottom periphery of the container. The bottom rim 122 provides a resting surface for the container in the upright position when the container is removed from the golf cart for cleaning or maintenance. Preferably, the bottom rim 122 is sized to accommodate the drain plug 62 when the container is placed in its upright position.

As shown in FIG. 8, the container 50 is provided with a portion of connector 124 to allow a golfing accessory to be attached to the container. Preferably, the container connector portion 124 is integrally formed with the container and as shown in FIG. 8, the connector comprises two notches 126 in the top rim 120 on the portion of the rim that extends along the obliquely angled portions 64,66 of the side walls and a notch 128 in the bottom rim 122 adjacent the obliquely angled side walls portions 64,66. Preferably, at least one, and more preferably, at least two connectors portions 124 are provided on the container, and preferably each is arranged on the container such that a golfing accessory may be positioned adjacent the obliquely angled side wall portions 64,66.

FIGS. 9–14 show an embodiment of a golfing accessory 150 which may be attached to the container of FIGS. 1–8. The golfing accessory shown in FIGS. 9–14 is a club washer, and for simplicity the details of the club washer have been omitted as these elements are known in the art. Being brief, the internals of the club washer essentially include a container of cleaning solution with a column of brushes vertically arranged inside. The golfer may insert a club head into the club washer to submerge the club head in the cleaning solution, and by moving the club head up and down, the brushes remove dirt and grass from the head of the club. The golfing accessory shown in FIGS. 9–14 is also preferably made from an ABS, carbon-filled plastic material that will withstand the elements and be sufficiently strong to withstand repeated, vigorous use and abuse.

Referring to FIGS. 9–14, the golfing accessory 150 is preferably provided with an arm 152 having a length that preferably corresponds to a vertical height of the obliquely angled side wall portions 64,66. A web portion 154 is provided between the arm 152 and the golfing accessory 150 to space the golfing accessory sufficiently away from the arm such that the golfing accessory is in an optimum position relative to the container 50 when the golfing accessory is releasably attached to the container. Preferably, the arm 152 is provided with a portion of a connector that complements or releasably engages with the container connector portion 124. Preferably, the golfing accessory connector portion comprises clips 156,158 at its opposite ends, and preferably the clips are biased toward each other to enable the golfing accessory to be securely attached to the container 50 at the top and bottom of the container. Preferably, the top arm clips 156 engage with the top rim notches 126 and the bottom arm clips 158 engage with the bottom rim notch 128 when the accessory is releasably attached to the container. Preferably, the clips 156,158 fit neatly within each of the rim notches 126,128 thereby providing a uniform appearance for each of the rims. In this way, the top arm clip 156 does not interfere with the engagement of lid 68 with the container in the closed position of the lid, and the bottom arm clip 158 does not interfere with the upright stability of the container. The clips 156,158 are preferably dimensioned such that they are flush with the rim when they are engaged with the rim thereby aligning with the profile of the container. Preferably, the arrangement of the clips 156,158 and the arm 152 allows the golfing accessory to be mounted to either one of the obliquely angled side wall portions 64,66.

Preferably, the arm 152 has a flat bearing surface 160 which conforms to either of the obliquely angled side wall portions 64,66. In order for the flat bearing surface 160 to conform to the tapered side walls or portions, the webbing 154 between the arm and the golfing accessory gradually increases towards the bottom of the arm. The cooperative abutment of the tapered side walls or portions and the arm bearing surface 160 provide a snug and secure fit for the golfing accessory 150 against the container 50 when it is releasably attached to the container.

In operation, the golfing accessory 150 may be attached to the container 50 by opening the lid 68 and aligning the top arms clips 156 with the top rim notches 126 and the bottom arm clip 158 with the bottom rim notch 128. Preferably, the top arm clips 156 are engaged first and the golfing accessory arm 152 is rotated such that that the arm bearing surface 160 abuts the respective tapered obliquely angled side wall portion of the first container. The bottom arm clip 158 may be deflected outward to allow the clip to pass over the bottom rim notch 128 whereafter the clip may be released to secure the bottom clip in the bottom rim notch. When it is desired to remove the golfing accessory from the first container, either one of the bottom clip or top clips may be deflected outward and released from their notches in the respective rim. The golfing accessory 150 may then be pivoted away from the container to a position where the other clip(s) no longer engage(s) the notch in the rim thereby releasing the golfing accessory from the first container.

FIGS. 15–20 show an alternative embodiment of the golfing accessory of FIGS. 9–14. In the embodiment shown in FIGS. 15–20, the golfing accessory 170 is a ball washer. For simplicity, the details of the ball washer have been omitted as these are known in the art. Being brief, the ball washer essentially comprises a cylindrically-shaped container having bristles positioned inside and a ball paddle adapted to move upwardly and downwardly adjacent the bristles. The container is filled with a cleaning solution and a ball may be placed in the paddle and repeatedly submersed in the cleaning solution. The upward and downward motion of the paddle rubs the ball against the bristles thereby removing any grass, dirt or scuffs on the golf ball.

In general, the golfing accessory 170 shown in FIGS. 15–20 is similar in construction to the golfing accessory shown in FIGS. 9–14 and like elements will be indicated with like reference characters. However, to interface the round, cylindrical shape of the ball washer with the relative flat sides of the first container, a plate 172 is provided in a perpendicular relationship to the web 154 at one end of the arm 152. At opposite ends of the plate 172, the golfing accessory connector portion is provided in the form of top clips 174 that are positioned to provide a secure connection between the golfing accessory 170 and the container 50. The golfing accessory 170 may then be attached to the container in the manner described previously. Preferably, the spatial arrangement of the ball washer top clips 174 matches the spatial arrangement of the club washer top clips 156 to allow the two golfing accessories to be interchanged, as desired.

FIGS. 21–27 show one configuration for an assembly where two different golfing accessories, the ball washer 170 and the club washer 150, are mounted to the container 50. By positioning the ball washer 170 and club washer 150 on the obliquely-angled side wall portions 64,66, the overall width of the golfing accessory assembly may be reduced, and the components may be positioned for more convenient access toward the front of the container. As shown in FIGS. 21–27, each of the golfing accessories 150,170 may be accessed without interference from the other of the golfing accessories or the container 50. The container lid 68 may then be lifted to provide access to the interior of the container without interference from either of the golfing accessories 150,170. The golfing accessories shown in FIGS. 21–27 may be arranged in a number of alternate configurations where the club washer may be placed on the left side instead of the right side and the ball washer may be placed on the right side instead of the left side. Additionally, either one of the golfing accessories may be removed as desired depending upon whether the golfing accessory is installed on the driver or passenger side of the golf car or installed in another position on the golf car.

The golfing accessory of the present invention provides a flexible method of customizing a golf car with the components and features that add convenience for the golfer. Other accessories may be mounted as will be apparent to those having ordinary skill in this art by using a similar attachment mechanism and using the container as the mounting platform for these accessories. It is intended that these other types of golfing accessories to be mounted to the container are within the scope of the invention.

In the example shown herein, the container connector portion 124 comprises two top rim notches 126 and one bottom rim notch 128 with which two top arm clips 156 and one bottom arm clip 158 engage when releasably attaching the golfing accessory to the container. However, it should be appreciated that the matching and engagable portions of the connector on the container and golfing accessory may be formed in other arrangements, and the combinations of clips and notches can be varied depending on the expected manner of use of the golfing accessory. Thus, the clips and notches may be reversed between the container and the golfing accessory in a manner such that the connector on the container comprises clips instead of notches where the notches on the golfing accessory engage with the clips of the container when releasably attaching the golfing accessory to the container. Further, the clips and notches may be provided in other locations on the container and golfing accessory, such as on the side wall of the container and on the midsection of the golfing accessory arm. Or, the container connector portion may be formed on another location on the container which may be more convenient depending upon the shape and manner of use of the golfing accessory. Further, another type or system of connectors may be used on the container and golfing accessory to releasably attach the golfing accessory to the container, such as a tab and sheath connector system where a portion of the container and golfing accessory may be deflected toward or away from the other to engage or disengage the two portions of the connector together. These variations are intended to be within the scope of the invention.

Various other changes may be envisioned by those of ordinary skill in the art to the preferred embodiments disclosed herein. However, those changes and modifications should be considered as part of the invention which is limited only by the scope of the claims appended hereto and their legal equivalents.

What is claimed is:

1. A container being adapted to attach to a golf car, the container having a portion of a connector integrally formed therein for attaching a golfing accessory to the container, said golfing accessory having a matching portion of the connector, the container connector portion being arranged to provide the sole support for the golfing accessory when the golfing accessory is releasably attached to the container, the container connector portion being configured to provide non-interfering use of both the container and the golfing accessory when the golfing accessory is releasably attached to the container;

a recess with tapered sidewalls; and a reinforcement plate attached to the golf car, the reinforcement plate having tapered edges capable of coupling with the tapered sidewalls of the recess to provide support for the container.

2. The container of claim 1 wherein the container connector portion comprises one of a plurality of container connector portions arranged on the container in a manner to allow the golfing accessory to be releasably attached to the container in a plurality of selected positions on the container.

3. The container of claim 1 wherein the container has a top rim around an upper portion of the container and the connector portion is provided on the rim.

4. The container of claim 1 wherein the container has a bottom rim around a lower portion of the container and the container connector portion is provided on the bottom rim.

5. The container of claim 1 wherein the container is a beverage cooler.

6. The container of claim 1 wherein the container has a back wall configured to allow the container to be supported by the golf car and an opposite front wall, each of the front and back walls is spaced apart by opposite left and right side walls, and the container connector portion is arranged on the container to permit the golfing accessory to be positioned adjacent one of the left and right side walls when the golfing accessory is releasably attached to the container.

7. The container of claim 6 wherein at least a portion of one of the left and right side walls is obliquely angled relative to the front and back walls, and the container connector portion is arranged on the container to permit the golfing accessory to be positioned adjacent at least one of the oblique portions of the left and right side walls when the golfing accessory is releasably attached to the container.

8. A container being adapted to attach to a golf car, the container having a portion of a connector integrally formed therein for attaching a golfing accessory to the container, said golfing accessory having a matching portion of the connector, the container connector portion being arranged to provide the sole support for the golfing accessory when the golfing accessory is releasably attached to the container, the container connector portion being configured to provide non-interfering use of both the container and the golfing accessory when the golfing accessory is releasably attached to the container; and wherein the container holds a divot hole mix material.

9. A container being adapted to attach to a golf car, the container having a portion of a connector integrally formed therein for attaching a golfing accessory to the container, said golfing accessory having a matching portion of the connector, the container connector portion being arranged to provide the sole support for the golfing accessory when the golfing accessory is releasably attached to the container, the container connector portion being configured to provide non-interfering use of both the container and the golfing accessory when the golfing accessory is releasably attached to the container;

wherein the container has a lid extending over the container for sealing the container; and wherein the container lid fits over the container connector portion.

10. A golfing accessory assembly for a golf car comprising:

a container adapted to attach to the golf car, the container having a portion of a connector integrally formed therein, a recess with tapered sidewalls; and a reinforcement plate attached to the golf car, the reinforcement plate having tapered edges capable of coupling with the tapered sidewalls of the recess to provide support for the container; and a golfing accessory having a matching portion of the container connector, the golfing accessory connector portion and the container connector portion being engageable in a manner to allow the golfing accessory to be releasably attached to the container without the use of separate fasteners and to allow the golfing accessory to be solely supported by the container, the golfing accessory releasably attaching to the container with their respective connector portions in a manner that provides non-interfering use of the container and the golfing accessory.

11. The golfing accessory assembly of claim 10 wherein the container connector portion is one of a plurality of container connector portions that allows the golfing accessory to be positioned in a plurality of selected positions on the container.

12. The golfing accessory assembly of claim 10 wherein the golfing accessory is one of a ball washer and club washer.

13. The golfing accessory assembly of claim 10 wherein one of the container connector portion and the golfing accessory connector portion has a clip and the other of the container connector portion and the golfing accessory portion has a cooperating notch and the clip engages the notch in releasably attaching the golfing accessory to the container.

14. The golfing accessory assembly of claim 10 wherein the golfing accessory is one of a ball washer and club washer.

15. The golfing accessory assembly of claim 10 wherein the container has a back wall configured to allow the container to be supported by the golf car and an opposite front wall, each of the front and back walls is spaced apart by opposite left and right side walls, and the container connector portion is arranged on the container to permit the golfing accessory to be positioned adjacent one of the left and right side walls when the golfing accessory is releasably attached to the container.

16. The golfing accessory assembly of claim 15 wherein at least a portion of one of the left and right side walls is obliquely angled relative to the front and back walls, and the container connector site portion is arranged on the container to permit the golfing accessory to be positioned adjacent at least one of the oblique portions of the left and right side walls when the golfing accessory is releasably attached to the container.

17. A golfing accessory assembly for a golf car comprising:

a container adapted to attach to the golf car, the container having a portion of a connector integrally formed therein;

a golfing accessory having a matching portion of the container connector, the golfing accessory connector portion and the container connector portion being engageable in a manner to allow the golfing accessory to be releasably attached to the container without the use of separate fasteners and to allow the golfing accessory to be solely supported by the container, the golfing accessory releasably attaching to the container with their respective connector portions in a manner that provides non-interfering use of the container and the golfing accessory; and wherein the first container is adapted to hold a divot hole mixture material.

18. A golfing accessory assembly for a golf car comprising:

a container adapted to attach to the golf car, the container having a portion of a connector integrally formed therein;

a golfing accessory having a matching portion of the container connector, the golfing accessory connector portion and the container connector portion being engageable in a manner to allow the golfing accessory to be releasably attached to the container without the use of separate fasteners and to allow the golfing accessory to be solely supported by the container, the golfing accessory releasably attaching to the container with their respective connector portions in a manner that provides non-interfering use of the container and the golfing accessory; and wherein the golfing accessory has a support arm extending along its length and the golfing accessory connector portion comprises clips positioned on opposite ends of the support am,, the clips are biased toward each other and engage the container in releasably attaching the golfing accessory to the container.

19. The golfing accessory assembly of claim 18 wherein the container has an upstanding wall and the golfing accessory support arm has a length which corresponds to a height of the upstanding wall and the golf accessory support arms clips engage a top and a bottom portion of the container upstanding wall in releasably attaching the golfing accessory to the container.

20. The golfing accessory assembly of claim 19 wherein the golfing container support arm conforms to the container upstanding wall.

21. A method comprising:

providing a container, the container being adapted to attach to a golf car, the container having a portion of a connector integrally formed thereon, wherein the container is adapted to hold a divot hole mixture material;

attaching the container to a golf car;

providing a golfing accessory wherein the golfing accessory has a matching portion of the container connector portion; and releasably attaching a first golfing accessory to the container by releasably engaging the connector portions of the first container and the first golfing accessory in a manner such that the first golfing accessory is solely supported by the container and does not interfere with the use of the container and the first golfing accessory when the first golfing accessory is releasably attached to the container.

22. The method of claim 21 wherein the step of providing the container includes providing the container wherein the container connector portion includes a plurality of container connector portions arranged in different location on the container, any one of the plurality of container connector portions being engagable with the first golfing accessory connector portion;

the method further comprising:

providing a second golfing accessory wherein the second golfing accessory has a connector portion that matches and is engageable with any one of the plurality of container connector portions; and releasably attaching a second golfing accessory to the container in a manner such that the second golfing accessory is solely supported by the container and does not interfere with use of the container, the first golfing accessory and the second golfing accessory.

23. The method of claim 21 wherein the step of providing the container includes providing the container wherein the container connector portion includes providing the container wherein the container connector portion includes a plurality of container connector portions arranges in different locations on the container, any one of the plurality of container connector portions being engageable with the first golfing accessory connector portion; and the step of releasably attaching the first golfing accessory includes releasably attaching the first golfing accessory to the container at one of a selected connector site on the first container.

* * * * *